US005807137A

United States Patent [19]

Janota et al.

[11] Patent Number: 5,807,137

[45] Date of Patent: Sep. 15, 1998

[54] SHIELDED ELECTRICAL RECEPTACLE CONNECTOR ASSEMBLY

[75] Inventors: Kenneth F. Janota, Lisle; Emaneul G. Banakis, Naperville; Harold Keith Lang, Fox River Grove; Brian Michael Scarth, Aurora, all of Ill.

[73] Assignee: Molex Incorporated, Lisle, Ill.

[21] Appl. No.: 726,179

[22] Filed: Oct. 4, 1996

[51] Int. Cl.[6] ..... H01R 13/648

[52] U.S. Cl. ..... 439/607; 439/946

[58] Field of Search ..... 439/607, 609, 439/59, 101, 108, 76.1, 946

[56] References Cited

U.S. PATENT DOCUMENTS

| | | | |
|---|---|---|---|
| 4,734,042 | 3/1988 | Martens et al. | 439/59 |
| 4,872,091 | 10/1989 | Maniwa et al. | 361/424 |
| 5,478,260 | 12/1995 | Kaufman et al. | 439/609 |

FOREIGN PATENT DOCUMENTS

| | | | |
|---|---|---|---|
| 0 406 610 B1 | 6/1995 | European Pat. Off. | G06K 7/06 |
| 256954-A | 3/1995 | Taiwan | H01R 33/94 |

OTHER PUBLICATIONS

AMP Catalog No. 65701, Rev. Sep. 1995, p. 18.

*Primary Examiner*—Gary F. Paumen
*Assistant Examiner*—Yong Ki Kim
*Attorney, Agent, or Firm*—Stacey E. Caldwell

[57] ABSTRACT

A shielded electrical receptacle connector assembly for an IC card includes a circuit substrate and a conductive cover for shielding the substrate. The assembly includes a housing adapted for mounting at a front edge of the circuit substrate. A plurality of terminals are mounted in the housing and are adapted for engaging circuit traces on the circuit substrate. A conductive shield is mounted on the housing and includes contact portions adapted for engaging ground circuit traces on the circuit substrate; a downwardly stepped lip extending along a rear edge of the shield vertically spaced from an overlapping front edge portion of the cover; attachment portions projecting from opposite ends of the downwardly stepped lip at a level spaced vertically from the cover for securing the shield to the housing; and at least one mounting finger projecting forwardly from the shield into a passage in a front mounting flange of the housing to hold the leading edge of the shield to the housing.

10 Claims, 4 Drawing Sheets

SHIELDED ELECTRICAL RECEPTACLE CONNECTOR ASSEMBLY

FIELD OF THE INVENTION

This invention generally relates to the art of IC cards and, particularly, to a shielded electrical receptacle connector assembly for an IC card which includes a circuit substrate and a conductive cover generally surrounding the substrate.

BACKGROUND OF THE INVENTION

Generally, IC cards or packs, such as memory cards, are data input devices which are electrically connected to an electronic apparatus or storage device, such as a word processor, personal computer or other electronic apparatus. The data stored in the IC card is transferred to the electronic apparatus. Memory cards are portable memory devices, in the shape of a rigid card, which are readily inserted and extracted from a connector apparatus used with the card for removably coupling the card to a printed circuit board, for instance.

A typical IC or pc card is shielded by a conductive cover to protect the electrical circuitry, and in particular, the electromagnetic signals, from externally generated radiated emissions. The card is also provided with EMI or grounding contacts along outside edges thereof to provide early discharge of internally generated static electricity in order to minimize the effects of electromagnetic pulses created during the dissipation of static charges through the signal contacts. Typically (according to such standards as PCMCIA), two grounding locations are established on the outside edges of the PC card with corresponding grounding contacts inside the guide arms of a card-receiving header connector. However, this standard grounding configuration is only intended for reduction of ESD and EMI/RFI effects, and does not address the effects of signal distortion. That is to say, in a given electrical circuit with given inductance and resistance values, the current flowing through the signal terminals must be balanced with the current flowing through the ground returns. If this balance is not achieved, voltage build-up can occur and a ground current can form, thus distorting the electrical signals and creating "ground bounce". Furthermore, at high switching speeds, the existing ground pins in the header connector are often insufficient to balance the signal terminals, and, if the grounding locations are connected to the ground pins, current can flow from the ground pins through the conductive cover and to the guide grounds creating a "ground loop". Such a "ground loop" flowing through the cover may create radiation and result in an antenna-like effect with the cover and the internal circuit board ground being at different electrical potentials.

In order to prevent such phenomena as ground bounce and ground loops in high speed connectors, particularly in the use of PC cards in computer applications, grounding shrouds have been used with card-receiving header connectors to electrically connect the ground of the PC card to the ground of the equipment or apparatus in which the card is being used. A known grounding shroud includes a plurality of ground contacts which engage a conductive portion of the PC card cover to balance the ground returns with the current flow to decrease voltage build-up and minimize the occurrence of ground bounce and ground loops. An example of this "CardBus" configuration is shown in U.S. Pat. No. 5,288,247 assigned to The Whitaker Corporation and has become the basis of an industry standard ("CardBus PC Card Standard") which specifies the physical and electrical characteristics of PC card connector configurations.

One method of adding ground paths in series to decrease voltage build-up and minimize the occurrence of ground bounce and ground loops is disclosed in U.S. Pat. No. 5,478,260. In that design, a grounding shroud is placed around a card-receiving header connector. The shroud includes a plurality of contacts which engage a portion of a PC card cover to balance the ground returns with the current flow of the system. A grounding shield is also placed around the memory card receptacle for direct grounding between the header shroud (i.e., system ground) and the internal circuit board of the PC card.

However, certain considerations in the design of a receptacle grounding shield must be noted so as not to compromise the electrical integrity of the entire system. Since the memory card cover and receptacle shield must be electrically isolated, any vertical overlapping of the components must be adequately spaced. Furthermore, horizontal gaps between the shield and cover must be minimized if the card is to remain free of contaminants during transportation and use. Thirdly, the length of the shield should be minimized in order that the cover can be maximized in the area of the shield to support and hold the receptacle within the card assembly. Fourth, the shield must be firmly held to the receptacle housing so as to prevent any deformation during assembly or stubbing during mating.

SUMMARY OF THE INVENTION

An object, therefore, of the invention is to provide a shielded electrical receptacle connector assembly for an IC card which includes an internal circuit board or substrate and a conductive cover generally surrounding the substrate.

The assembly includes an electrical connector having an elongated dielectric housing. The housing includes opposite ends and a front mating face and a rear terminating face extending generally between the ends. The housing is adapted for mounting at a front edge of the internal circuit board. A plurality of terminals are mounted on the housing and are adapted for engaging appropriate circuit traces on the circuit board. A conductive shield is mounted on the housing and extends generally between the ends thereof. The shield includes contact portions adapted for engaging appropriate ground circuit traces on the circuit board. The shield includes a downwardly stepped lip along a rear edge portion of the shield and extending beneath an overlapping front edge portion of the cover.

As disclosed herein, the downwardly stepped lip portion of the shield and the overlapping front edge portion of the cover are spaced vertically from each other to electrically isolate the shield and the cover. The housing includes a mounting arm having bottom face for mounting to the circuit board, the shield is mounted to a top face of the housing and the contact portions project downwardly from the rear terminating face of the housing toward the circuit board for mounting thereto.

The shield includes attachment portions projecting from opposite ends of the downwardly stepped lip for fixing to the housing. The cover includes arm portions extending forwardly over the end portions of the housing, above the attachment portions and outside opposite ends of the shield.

The shield further includes at least one mounting finger projecting forwardly of the shield into a passage formed in a front mounting flange of the housing. Preferably, a plurality of the mounting fingers are spaced longitudinally along a front edge of the shield and are secured within corresponding passages in the flange to hold down the leading edge of the shield.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
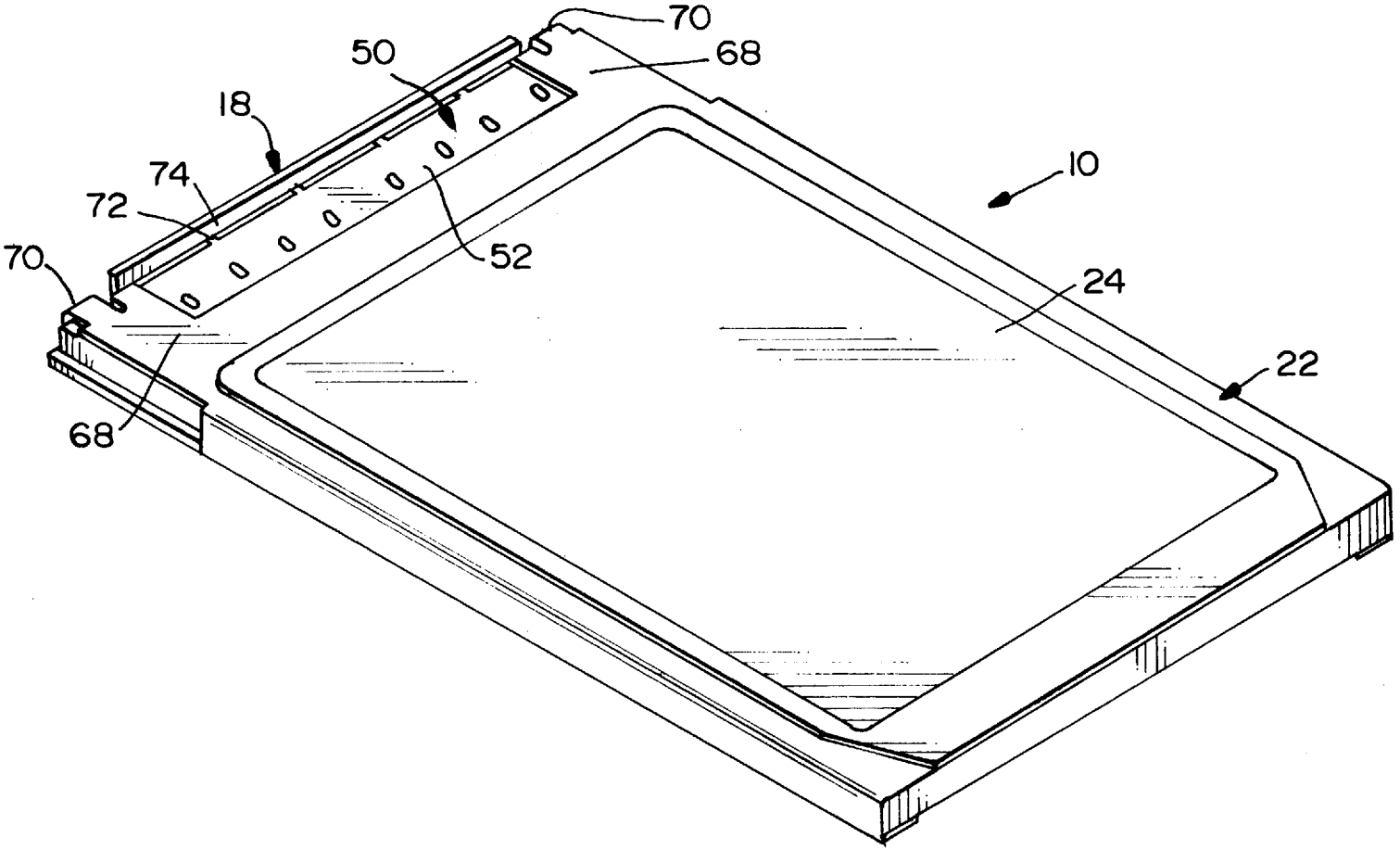
FIG. 1 is a perspective view of an IC card embodying the concepts of the invention.
Figure 2:
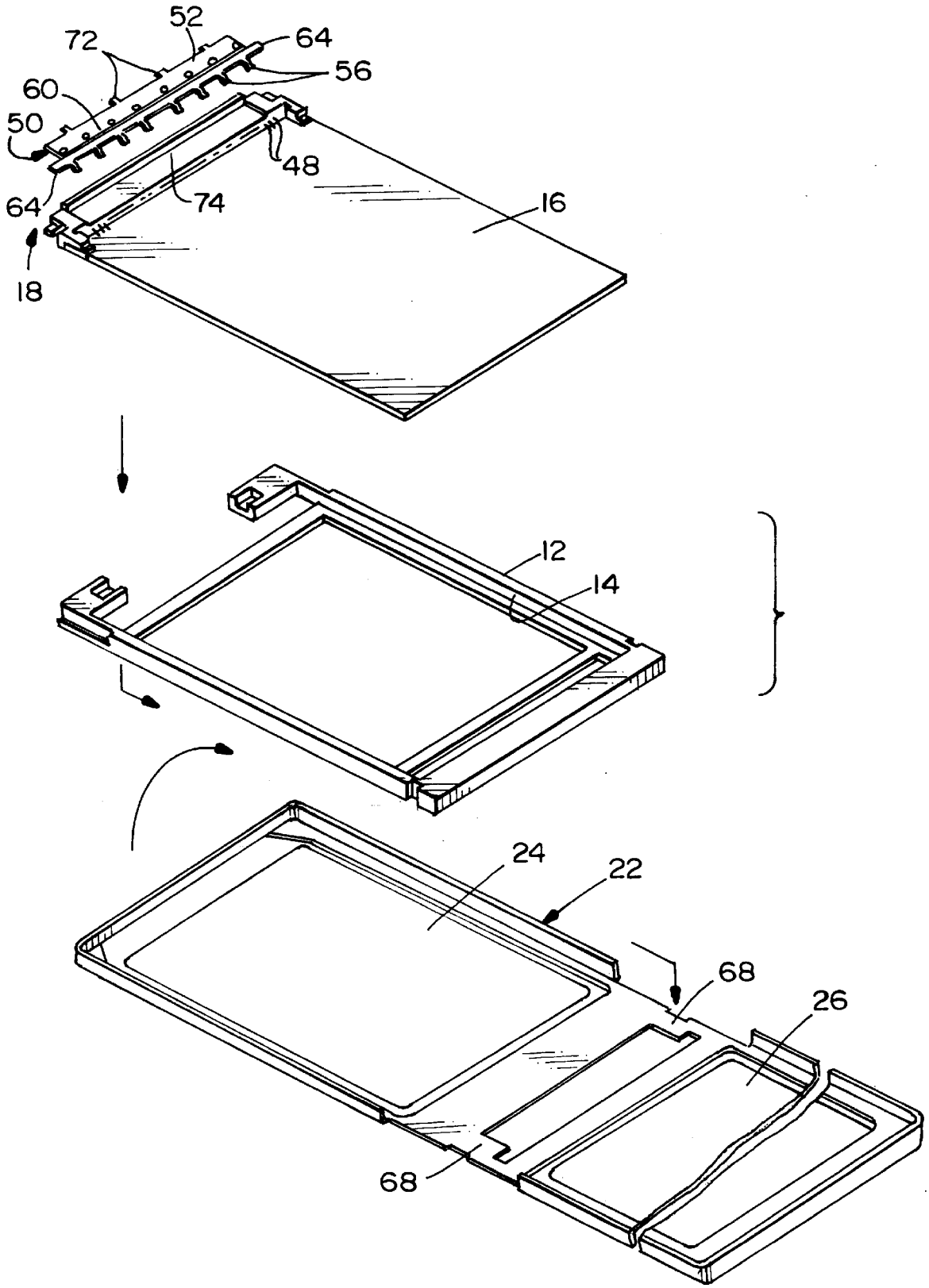
FIG. 2 is an exploded perspective view of the components of the IC card.

Referring to the drawings in greater detail, and first to FIGS. 1 and 2, the invention is embodied in an IC card, generally designated 10, which includes a generally rectangular frame 12 including an opening 14 which receives an internal circuit board or substrate 16. A receptacle connector, generally designated 18, is mounted on the frame and/or on the board at a front or insertion end thereof. A conductive shell, generally designated 22, substantially encompasses or surrounds the frame and circuit substrate. The shell shown herein is a one-piece clam-shell configuration to define a top cover 26 and a bottom cover 24 which substantially sandwich and surround internal circuit substrate 16 therebetween, leaving the mating face of connector 18 exposed at the front of IC card 10. The shell could also be constructed of two separate cover pieces which sandwich the circuit board in the same way.

It should be understood that receptacle connector 18 typically is adapted for insertion into a header connector (not shown) which provides an interconnection between IC card 10 and a main printed circuit board of an electronic apparatus such as a desktop or laptop computer. The header connector is equipped with a ground shield.

Figure 3:
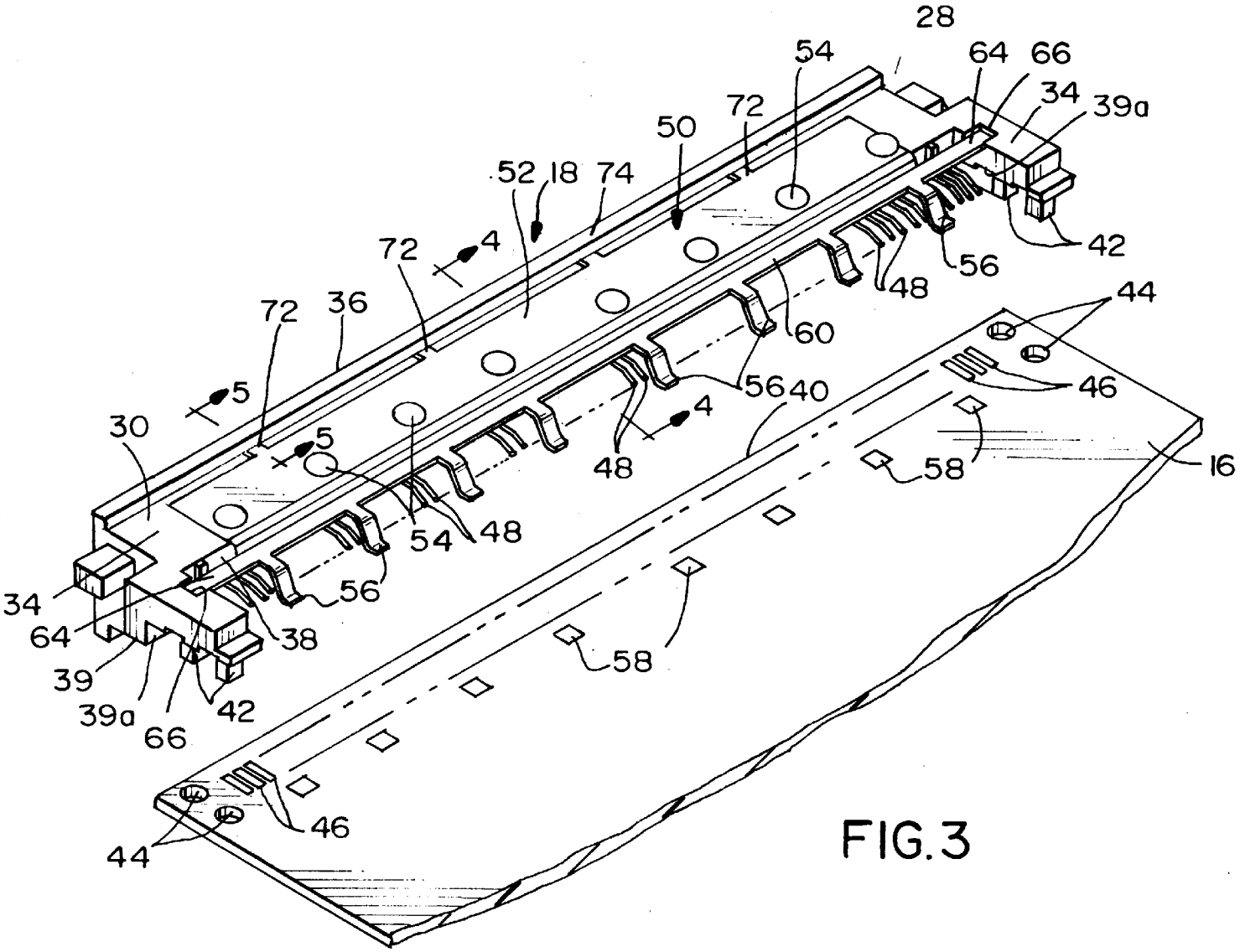
FIG. 3 is a perspective view of the receptacle connector and shield, in conjunction with the front edge of the internal circuit substrate of the IC card.

Referring now to FIG. 3, receptacle connector 18 includes an elongated dielectric housing, generally designated 28, which includes a top face 30, a bottom face 32, opposite ends 34, and a front mating face 36 and rear terminating face 38 extending generally between the ends. Mounting arms 39 are located near each opposite end 34 of the housing to facilitate mounting the housing at an edge 40 of circuit board 16. The bottom surface of mounting arm 39 has a stepped portion 39*a* with a pair of mounting posts 42 depending downwardly therefrom for insertion into a pair of corresponding mounting holes 44 in the circuit board. Therefore, front edge 40 of the board is seated in the stepped portion 39*a* of mounting arms 39 of the housing.

FIG. 3 also shows a plurality of circuit pads 46 which extend in a row along and adjacent to front edge 40 of the circuit board. Generally, a plurality of receptacle 20 terminals are mounted in housing 28 and are adapted for engaging appropriate circuit traces on circuit board 16. Specifically, FIG. 3 shows a plurality of terminal tail portions 48 of terminals 20 projecting rearwardly of terminating face 38 of the housing for engaging circuit pads 46 on the board.

Figure 4:
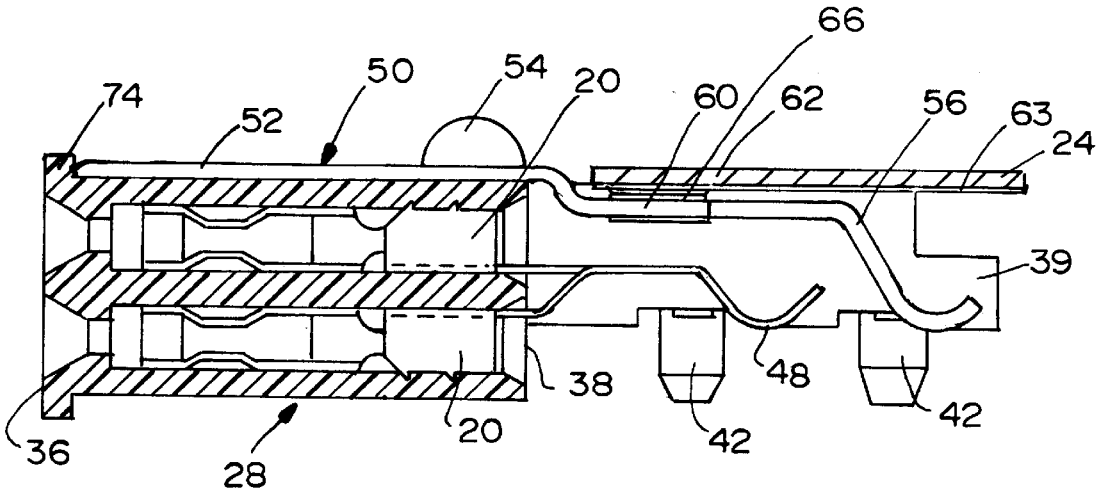
FIG. 4 is a front-to-rear vertical section of the receptacle connector and shield with a portion of the top cover, taken generally along line 4—4 of FIG. 3.

A conductive shield, generally designated 50, is mounted on housing 28 and extends generally between opposite ends 34 of the housing. Referring to FIG. 4 in conjunction with FIG. 3, shield 50 includes an elongated main plate portion 52 having a row of upwardly protruding "bumps" or contacts 54 spaced lengthwise therealong. The contacts are adapted for engaging the ground shield of the receiving header connector on the main printed circuit board. A plurality of shield tail portions 56 project rearwardly of the shield beyond rear terminating face 38 of the housing for engaging corresponding ground circuit pads 58 on circuit board 16.

As shown most clearly in FIGS. 3 and 4, a generally planar downwardly stepped lip 60 extends lengthwise along a rear edge of plate portion 52 of the shield. As best seen in FIG. 4, downwardly stepped lip 60 is in a plane spaced vertically and downwardly from or below plate portion 52 of the shield. The downwardly stepped lip also is shown to be below and extending beneath an overhanging front edge portion 62 of top cover 24. As seen in FIG. 4, the stepped lip is spaced from the overlapping front edge portion of the cover to electrically isolate the shield from the cover, yet the horizontally overlapping portions eliminate any gaps to minimize entry of contaminants into the internal space of the IC card and prevent tampering of the internal components with small objects. Furthermore, the overlapping front edge of the cover portion can actually improve the shielding characteristics of the card, since the electrical signals are moving through the receptacle terminals below. The underside of top cover 24 can include a dielectric layer 63 of, for example, mylar tape to ensure the electrical isolation of the shield and cover.

Another feature of the invention is best seen in FIG. 3, wherein generally planar attachment portions 64 of shield 50 project from opposite ends of downwardly stepped lip 60 for engagement within lip recesses 66 in mounting arms 39 of housing 28. The attachment portions are securely press-fit in a vertical direction within recesses 66 in the housing to prevent movement of the shield relative to the housing to maintain the integrity of the solder joints of the shield tail portions particularly during mating of the card.

Since attachment portions 64 extend from downwardly stepped lip 60 of the shield, the attachment portions are also located generally in a plane spaced vertically below plate portion 52 of the shield and spaced vertically below front edge portion 62 of top cover 24, as described above in relation to FIG. 4. Therefore, as seen in FIG. 1, arm portions 68 of top cover 24 can extend forwardly over top surface 30 of the housing substantially inwardly of end portions 34 to the extreme front edge of the housing, without contacting the shield. These arm portions 68 support receptacle connector 18 within the covers and minimize unwanted upward movement of the receptacle connector once the covers are assembled, thereby improving the integrity and rigidity of the entire assembly and more specifically, ensuring the integrity of the soldered connections of shield tail portions 56 and terminal tail portions 48 to the internal circuit board. This is achieved by securing attachment portions 64 within recesses 66 of the housing such that the plate portion 52 and the stepped lip from which the attachment portions extend are vertically spaced from one another, and the stepped lip is spaced vertically below top cover 24 as well.

Figure 5:
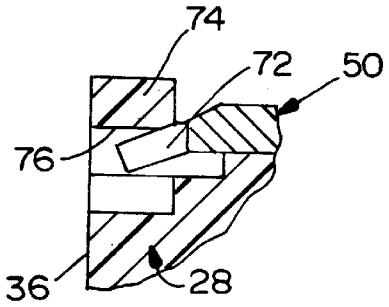
FIG. 5 is an enlarged, fragmented section taken generally along line 5—5 of FIG. 3.

A further feature of the invention is the provision of at least one mounting finger 72 projecting forwardly of shield 50 into a passage or hole 76 in a front mounting flange 74 of housing 28. Actually, as seen in FIG. 3, a plurality of mounting fingers 72 are spaced longitudinally along a front edge of plate portion 52 of the shield. As seen best in FIG. 5, these mounting fingers 72 extend forwardly into passages 76 formed through mounting flange 74 at the front of housing 28. These mounting fingers hold the leading edge of the shield down onto the housing and prevent stubbing and deformation during mating and assembly of the receptacle connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical receptacle connector assembly for an IC card which includes a circuit substrate and a conductive cover generally surrounding the substrate, comprising:

a receptacle connector including an elongated dielectric housing having opposite ends, and a front mating face and a rear terminating face extending generally between the ends, the housing being adapted for mounting at a front edge of the circuit substrate;

a plurality of terminals mounted in the housing and adapted for engaging corresponding circuit traces on the circuit substrate; and a conductive shield mounted on the housing including a plate portion extending generally between said opposite ends, a downwardly stepped lip extending substantially uninterrupted along a rear edge portion of the plate portion such that the lip is vertically spaced from a horizontally overlapping front edge portion of the cover to electrically isolate the shield and the cover and a plurality of contact portions extending from the downwardly stepped lip adapted for engaging corresponding ground circuit traces on the circuit substrate.

2. The shielded electrical receptacle connector assembly of claim 1 wherein said housing includes a mounting arm having a bottom face adapted for mounting to the circuit substrate, said shield is mounted to a top face of the housing, and said contact portions of said shield project downwardly from the rear terminating face of the housing toward the circuit substrate.

3. The shielded electrical receptacle connector assembly of claim 1 wherein said shield includes attachment portions projecting from opposite ends of the downwardly stepped lip at a level vertically spaced from the cover for securely fixing the shield to the housing.

4. The shielded electrical receptacle connector assembly of claim 3 wherein said cover includes arm portions extending forwardly over a top face of the housing outside opposite ends of the shield and vertically spaced from said attachment portions.

5. The shielded electrical receptacle connector assembly of claim 1 wherein said shield includes at least one mounting finger projecting forwardly of the shield into a passage formed in a front mounting flange of the housing.

6. The shielded electrical receptacle connector assembly of claim 5, including a plurality of said mounting fingers spaced longitudinally along a front edge of the shield.

7. A shielded electrical receptacle connector assembly for an IC card which includes a circuit substrate and a conductive cover generally surrounding the substrate, comprising:

an electrical receptacle connector including an elongated dielectric housing having opposite ends, a front mating face and a rear terminating face extending generally between the ends, the housing being adapted for mounting at a front edge of the circuit substrate;

a plurality of terminals mounted in the housing and adapted for engaging corresponding circuit traces on the circuit substrate; and a conductive shield mounted on the housing and including a plate portion extending generally between said opposite ends, a downwardly stepped lip portion extending substantially entirely along a rear edge of said plate portion and spaced vertically therefrom, attachment portions for fixing the shield to the housing projecting from opposite ends of the downwardly stepped lip portion, and contact portions extending from said downwardly stepped lip portion and adapted for engaging corresponding ground circuit traces on the circuit substrate.

8. The shielded electrical receptacle connector assembly of claim 7 wherein said cover includes arm portions extending forwardly over a top surface of the housing outside opposite ends of the shield and vertically spaced from said attachment portions.

9. The shielded electrical receptacle connector assembly of claim 7 wherein said housing includes a mounting arm for mounting to the circuit substrate, the shield being mounted to a top surface of the housing, and said contact portions project downwardly from the rear terminating face of the housing for mounting to the circuit substrate.

10. The shielded electrical receptacle connector assembly of claim 7 wherein said shield includes a plurality of mounting fingers projecting forwardly of the shield into passages formed in a front mounting flange of the housing and spaced longitudinally along a front edge of the shield.

* * * * *